United States Patent [19]

Enzaki et al.

[11] Patent Number: 4,695,247

[45] Date of Patent: Sep. 22, 1987

[54] COMBUSTOR OF GAS TURBINE

[75] Inventors: Yoshiki Enzaki; Kazuki Kitahara, both of Kobe; Satoru Terasaka, Kakogawa; Kenji Mori, Akashi; Takeshi Kimura, Kobe, all of Japan

[73] Assignee: Director-General of the Agency of Industrial Science & Technology, Japan

[21] Appl. No.: 833,268

[22] Filed: Feb. 26, 1986

[30] Foreign Application Priority Data

Apr. 5, 1985 [JP] Japan ..... 60-71055

[51] Int. Cl.[4] ..... F23D 14/02

[52] U.S. Cl. ..... 431/352; 431/351; 60/755; 60/756

[58] Field of Search ..... 431/351, 352, 160; 60/756, 755

[56] References Cited

U.S. PATENT DOCUMENTS

| | | | |
|---|---|---|---|
| 2,699,648 | 1/1955 | Berkey | 60/756 |
| 2,919,549 | 1/1960 | Haworth et al. | 431/351 X |
| 3,840,332 | 10/1974 | Smith | 431/351 |
| 3,898,797 | 8/1975 | Wood | 431/352 X |
| 4,064,300 | 12/1977 | Bhangu | 431/352 X |
| 4,104,874 | 8/1978 | Carmel et al. | 431/351 X |
| 4,567,730 | 2/1986 | Scott | 60/755 |

FOREIGN PATENT DOCUMENTS

| | | | |
|---|---|---|---|
| 994115 | 8/1976 | Canada | 60/756 |
| 2555814 | 6/1976 | Fed. Rep. of Germany | 60/755 |
| 1301577 | 2/1977 | Japan . | |
| 721209 | 1/1955 | United Kingdom . | |
| 790292 | 2/1958 | United Kingdom . | |
| 1442350 | 7/1976 | United Kingdom . | |
| 2049152 | 12/1980 | United Kingdom . | |
| 2054127 | 2/1981 | United Kingdom . | |
| 2061482 | 5/1981 | United Kingdom . | |
| 2125950 | 3/1984 | United Kingdom . | |
| 200964 | 12/1968 | U.S.S.R. | 60/756 |

*Primary Examiner*—Randall L. Green

*Attorney, Agent, or Firm*—Leydig, Voit & Mayer

[57] ABSTRACT

A combustor of a gas turbine having a double wall construction in one part of the combustor, wherein an outer plate is formed with a multiplicity of cooling air inlet apertures and an inner plate is formed with a multiplicity of cooling air outlet apertures. The inner and outer plates are connected together by a multiplicity of connectors formed of heat conductive material and define therebetween a space. The cooling air inlet apertures are greater in diameter but smaller in total area than the cooling air outlet apertures which are inclined at an angle of 30 degrees. Cooling air introduced into the space through the cooling air inlet apertures impinge on the inner surface of the inner plate and performs impinge cooling while the connectors perform pin fin cooling. The cooling air also performs film cooling as it flows along the outer surface of the inner plate after cooling the walls of the cooling air outlet apertures while being released.

8 Claims, 7 Drawing Figures

COMBUSTOR OF GAS TURBINE

BACKGROUND OF THE INVENTION (1) Field of the Invention

This invention relates to a combustor of a gas turbine comprising, in combination, film cooling means, pin fin cooling means and impingement cooling means for cooling wall surfaces of a combustor.

(2) Description of the Prior Art

To cope with a high temperature during operation, the combustor of a gas turbine has hitherto been provided with cooling means for cooling its wall surfaces.

It has hitherto been usual practice for the combustor to be provided with one of the film cooling means, pin fin cooling means and impingement cooling means or all or two of them in combination.

Japanese Patent Laid-Open No. 13015/77 discloses one example of cooling means comprising the aforesaid cooling means in combination, for example.

Of these three cooling means, the film cooling means forms a thin layer of cooling air in film form along the inner surface of the combustor. This cooling means is capable of achieving higher cooling effects than the other two cooling means.

In the film cooling means disclosed in the prior art document referred to hereinabove, a wall plate constituting a shell of the combustor is split into a multiplicity of wall members located axially of the combustor and successively arranged such that portions of the adjacent wall members overlap each other to define a cooling air space therebetween. Cooling air is introduced into this space and allowed to flow along the inner wall surface after being released from the space.

In the combustor provided with this film cooling means, the construction of the combustor is complex because the multiplicity of wall members are arranged to provide overlaps, so that fabrication of the combustor is difficult to perform and construction cost is high. An added disadvantage is that the combustor as a whole leaves something to be desired in strength.

In the combustor provided with the film cooling means of the aforesaid construction, the cooling air merely flows between the wall members, and difficulty has been experienced in cooling some particular surface portions of the wall plate. For example, an air inlet port is located at the wall plate of the combustor. When the film cooling means of the aforesaid construction is used, the cooling air does not flow in sufficiently large amounts to the wall surface portion disposed downstream of the air inlet port and such wall surface portion fails to be cooled sufficiently.

SUMMARY OF THE INVENTION

This invention has been developed for the purpose of obviating the aforesaid disadvantages of the prior art. Accordingly, the invention has as its object the provision of a combustor of a gas turbing provided with film cooling means, pin fin cooling means and impingement cooling means for effectively cooling the combustor, particularly for cooling locallized wall surface portions by the film cooling means, which is constructed such that the combustor is easy to fabricate, low in cost and high in strength.

To accomplish the aforesaid object, the present invention provides a combustor of a gas turbine comprising wall means of double wall construction including an outer plate member and an inner plate member located at least in one part of the combustor, connector means including a multiplicity of connectors formed of heat conductive material for connecting together the outer plate member and inner plate member of the wall means, and cooling air flow aperture mean including a multiplicity of cooling air inlet apertures formed in the outer plate member to introduce cooling air therethrough from outside into a space defined between the outer and inner plate members perpendicularly to an inner surface of the inner plate member, and a multiplicity of cooling air outlet apertures formed in the inner plate member to allow the cooling air to flow along an inner surface of the inner plate member after being released into the interior of the combustor from the space between the outer and inner plate members.

In the combustor according to the present invention, a part of the wall is formed as a double wall of simple construction, and the cooling air is allowed to flow through the cooling air outlet apertures formed in the inner plate of the wall and along the inner surface of the inner plate member of the wall, to thereby sufficiently cool the entire surface of the inner plate member of the wall including those areas which have hitherto been beyond the power of cooling means of the prior art.

DESCRIPTION OF THE PREFERRED EMBODIMENTS

Figure 1:
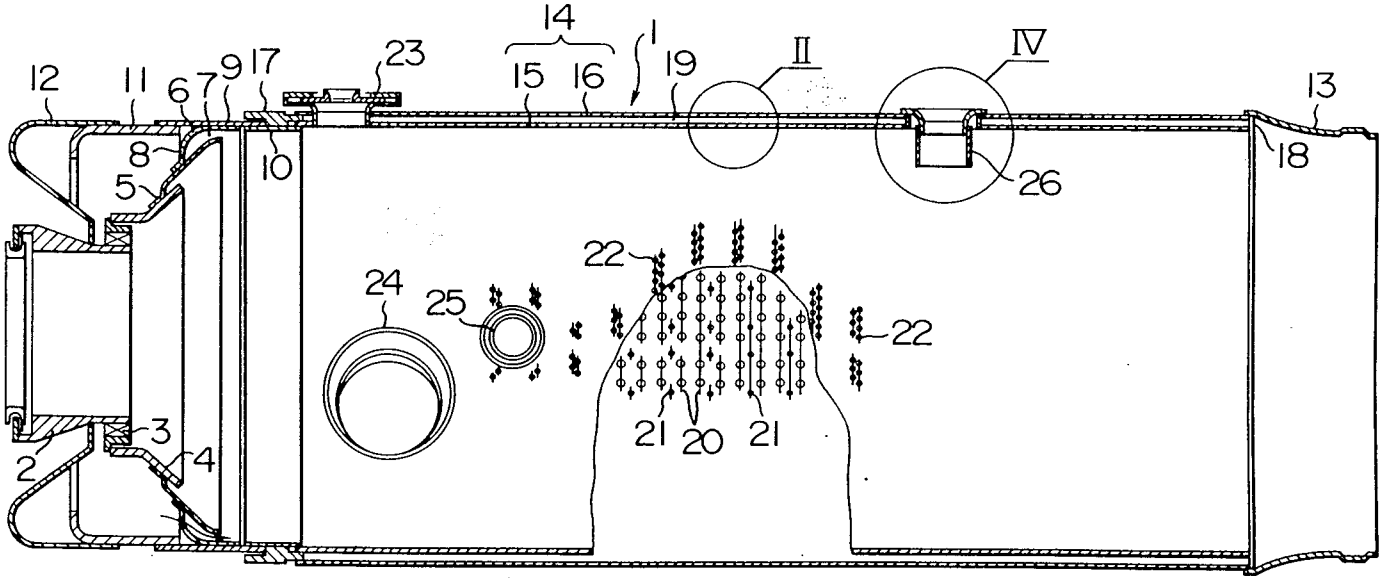
FIG. 1 is a sectional view of the combustor comprising one embodiment of the invention.

FIG. 1 shows one embodiment of the invention, in which the reference numeral 1 designates one of the cans of the combustor of multiple can type having a nozzle mounting cylinder 2 mounting a fuel nozzle, not shown.

A swirler 3 is located at the outer periphery of the nozzle mounting cylinder 2 and has a support cylinder 4 located at its outer periphery.

A first head plate 5 and a second head plate 6 are located at the outer periphery of the support cylinder 4 and connected to each other in such a manner that portions of them overlap and define therebetween a cooling air outlet space 7. Cooling air introduced through cooling air inlet apertures 8 formed in the second head plate 6 into the cooling air outlet space 7 is released therefrom.

A first connecting cylinder 9 is located at the outer periphery of the second head plate 6 and a second connecting cylinder 10 is located concentrically with the second head plate 6 at one end thereof. The numeral 11 designates an end plate located at the head of the combustor and having a flow dividing plate 12.

The numeral 13 designates an end plate located at the tail of the combustor which is connected to a transition duct, not shown.

An inner shell main body 14 located between the head and the tail of the combustor is of double wall construction and comprises an inner plate 15 and an outer plate 16.

More specifically, a connecting ring 17 is joined by welding to the right end of the first connecting cylinder 9 as seen in FIG. 1, and one end portion of the inner plate 15 is joined by welding to the inner periphery of the connecting ring 17 and one end of the outer plate 16 is joined by welding to the outer periphery of the connecting ring 17. The inner plate 15 and outer plate 16 are connected together at their right ends, as seen in FIG. 1, to close a space 19 defined by the inner and outer plates 15 and 16. The end plate 13 at the tail of the combustor is joined by welding to the outer periphery of the outer plate 16.

The inner plate 15 and outer plate 16 are equal in axial length and axially parallel to each other to provide a perfect double wall.

Figure 2:
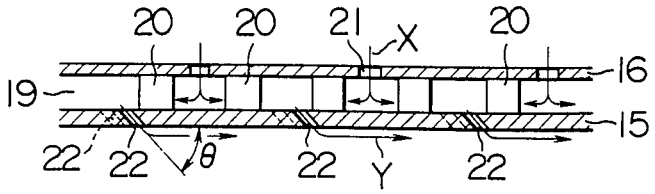
FIG. 2 is a view, on an enlarged scale, of the portion designated by II in FIG. 1.

The space 19 between the inner plate 15 and outer plate 16 serves as a space for cooling air to flow therethrough. A multiplicity of connectors 20 in the form of pins formed of heat conductive material are located between the inner surface of the outer plate 16 and the outer surface of the inner plate 15, as shown in FIG. 2, to connect the inner and outer plates 15 and 16 by diffusion bonding.

Figure 3:
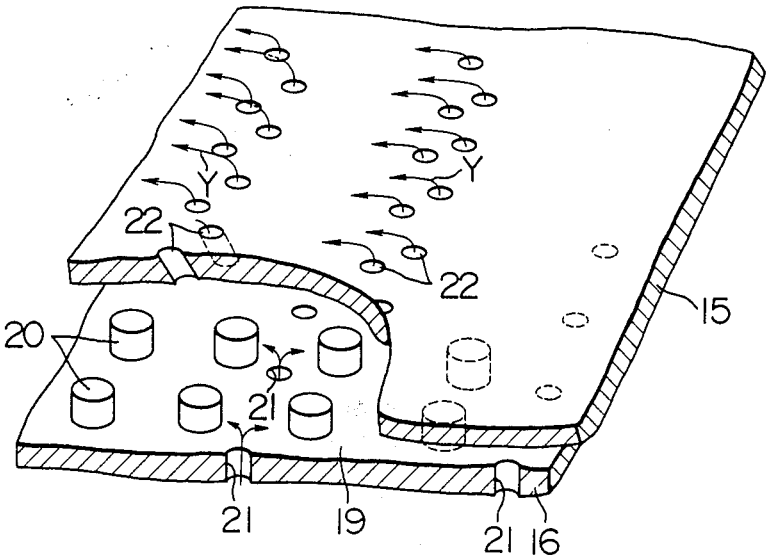
FIG. 3 is a perspective view of the portion of the combustor shown in FIG. 2 but showing said one portion in an upside down position, in explanation of the flow of the cooling air currents.

The outer plate 16 is formed with a multiplicity of cooling air inlet apertures 21 at the entire surface thereof. Each aperture 21 is formed by drilling and is located between rows of the connectors 20, as shown in FIG. 3. Cooling air supplied from between the inner shell main body 14 and an outer shell, not shown, is introduced through the cooling air inlet apertures 21 into the cooling air flow space 19 and flows perpendicular to the outer surface of the inner plate 15 until it impinges thereon to cool the inner plate 15 by impingement cooling. Then, pin fin cooling is performed with respect to the connectors 20.

The inner plate 15 is formed with a multiplicity of cooling air outlet apertures 22 by electrodischarge machining.

The cooling air outlet apertures 22 are constructed such that they are inclined to rearward. The apertures 22 are located where the connectors 20 and cooling air inlet apertures 21 of the outer plate 16 are not located.

As shown in FIG. 3, the cooling air outlet apertures 22 are arranged in a plurality of rows with the apertures 22 in the adjacent rows being located in staggered relation. As shown in FIG. 1, the rows of cooling air outlet apertures 22 extend peripherally of the inner plate 15 and spaced apart from each other axially of the inner plate 15.

It will be seen in FIG. 3 that the cooling air inlet apertures 21 are greater in diameter than the cooling air outlet apertures 22, but the apertures 21 are smaller in total area than the apertures 22. More specifically, the ratio of the total area of the cooling air outlet apertures 22 to the total area of the cooling air inlet apertures 21 is approximately 3 to 4. By virtue of this feature, the cooling air flowing through the cooling air inlet apertures 21 in the direction of an arrow X in FIG. 2 has its velocity increased to enable impingement cooling and pin fin cooling to be performed with satisfactory results, and the cooling air flowing through the cooling air outlet apertures 22 in the direction of an arrow Y has its velocity reduced to enable the cooling air to be released from the space 19 at a low velocity to effectively cool the inner surface of the inner plate 15 by film cooling.

Figure 4:
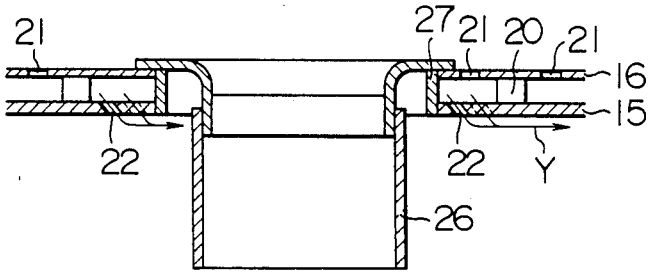
FIG. 4 is a view, on an enlarged scale, of the portion indicated by IV in FIG. 1.

The inner shell main body 14 composed of the inner plate 15 and outer plate 16 has mounted thereto an ignition plug port 23, two cross fire tubes 24 connecting the cans of the combustor together, some primary air inlet ports 25, and some cylindrical dlution air port 26 as shown in FIG. 1. FIG. 4 shows one example of means for effectively cooling a localized portion of the inner surface of the inner plate 15.

In FIG. 4, the cylindrical dilution air port 26 supported by a support cylinder 27 has the cooling air outlet aperture 22 located in a portion of the inner plate 15 which is located downstream (right side in the figure) of the support cylinder 27, so as to effectively cool the localized area of the inner surface portion of the inner plate 15.

In the combustor of the aforesaid construction, the inner plate 15 and outer plate 16 are axially parallel to each other so that the former is enclosed by the latter and the two plates 15 and 16 are connected together by the connectors 20, as shown in FIG. 1. That is, the combustor has a perfect double wall structure. The construction of the combustor is simpler and has higher strength, in spite of being simple, than that of the combustor of the prior art in which the wall plate is split into a multiplicity of wall members arranged to provide overlaps defining a space for cooling air to flow therethrough. The combustor according to the invention is easy to fabricate.

The cooling air flowing in the direction of the arrow X in FIG. 2 performs impingement cooling and pin fin cooling. Film cooling is performed by the cooling air flowing through the cooling air outlet apertures 22 formed in the inner plate 15. This offers the advantage that the inner plate 15 is cooled through the walls of the apertures 22 and at the same time the inner surface of the inner plate 15 is cooled by film cooling performed by currents of cooling air branching after being released through the cooling air outlet apertures 22.

In the embodiment shown and described hereinabove, impingement cooling and pin fin cooling can achieve satisfactory results because the flow velocity of the cooling air through the cooling air inlet apertures 21 in the X direction is increased. Film cooling can also achieve satisfactory results because the flow velocity of the cooling air through the cooling air outlet apertures 22 in the Y direction is reduced to facilitate the flow of cooling air along the inner surface of the inner plate 15. Moreover, since the cooling air outlet apertures 22 are inclined in the direction of the main flow, the effects achieved by the film cooling are increased. In addition to the film cooling having its effects increased, the inner plate 15 as a whole can be cooled more effectively because the area of the inner plate 15 brought into contact with the cooling air through the walls of the cooling air outlet ports 22 is increased.

By forming the cooling air outlet apertures 22 in localized areas of the inner plate 15 where difficulty would otherwise be experienced in performing film cooling, such as a localized area disposed downstream of the support cylinder 27 for the cylindrical dilution air port 26, it is possible to effectively cool the localized areas of the inner surface of the inner plate 15 by film cooling.

As described hereinabove, the inner plate 15 is supported by the outer plate 16. This arrangement permits the inner plate 15 to be designed with emphasis being placed on its function of cooling the shell of the combustor. This increases the latitude with which the configuration and location of the cooling air outlet apertures 22 are designed and makes it possible to control the flow rate of cooling air, particularly to optimize the volumes of cooling air released to different portions of the inner surface of the inner plate 15. Generally, the thermal load applied to the inner surface of a combustor is not uniform. The magnitude of the thermal load applied to the inner surface of the combustor varies from one portion to another. Thus, the present invention has particular utility when limitations are placed on the volume of air that can be used for cooling purposes.

The invention can have application in a transition duct which is not shown. Also, the inner plate 15 may be split into two portions across its length which are connected together by the outer plate 16.

Figure 5:
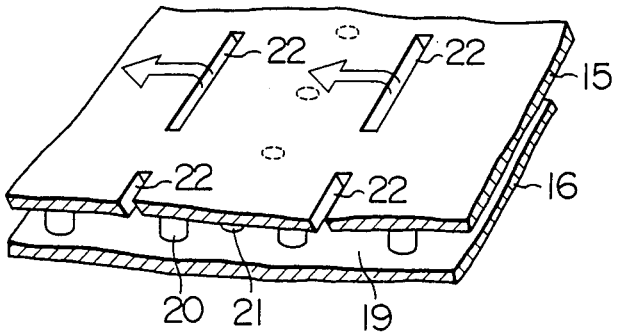
FIG. 5 is a perspective view similar to FIG. 3 but showing a portion of the combustor comprising another embodiment in which the cooling air outlet apertures are in the form of slits.
Figure 6:
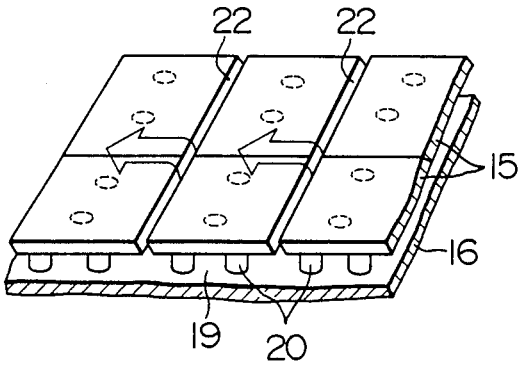
FIG. 6 is a perspective view similar to FIG. 5 but showing a portion of the combustor comprising still another embodiment in which the inner plate member of the wall is split into rectangular members resembling tiles and the cooling air outlet apertures are in the form of slits.
Figure 7:
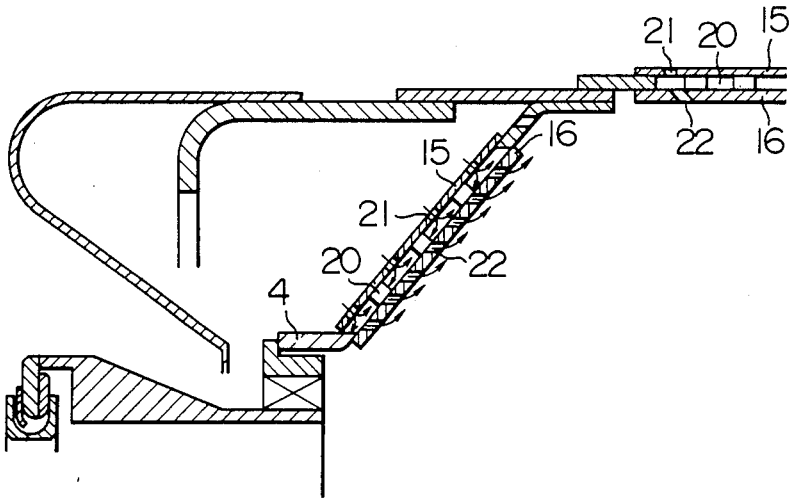
FIG. 7 is a section view of the head of the combustor which is provided with a wall of double wall construction according to the invention.

The configuration and position of the connectors 20, cooling air inlet apertures 21 and cooling air outlet apertures 22 shown and described by referring to one embodiment of the invention are not mandatory. FIG. 5 shows another embodiment in which the cooling air outlet apertures 22 are in the form of slits. In this connection, the inner plate 15 may be composed of a multiplicity of rectangular members resembling tiles which are arranged, as shown in FIG. 6 to define therebetween the cooling air outlet slits 22. In this embodiment, the inner plate 15 can be formed of heat resistant metal of a cobalt or nickel base which is not high in formability, so that the durability of the inner plate 15 can be prolonged. In the embodiment shown in FIG. 1, the head is provided with a wall composed of a plurality of head plates having overlapping portions to define a cooling air passageway therebetween. However, the head may, as shown in FIG. 7, be provided with a wall of the double wall construction. The embodiment shown in FIG. 1 has been described as being one of the cans of a combustor of the multiple can type. However, this is not mandatory and the invention can also have application in a combustor of the annular type.

From the foregoing description, it will be appreciated that the combustor of a gas turbine according to the invention has a double wall construction in one part of its shell and cooling air is allowed to flow through the cooling air outlet apertures formed in the inner plate to cool the inner plate by the cooling air flowing through the outlet apertures and along the inner surface of the inner plate. The cooling air outlet aperture is located to enable even a localized area of the inner plate to be cooled by the cooling air. Thus, the combustor according to the invention is capable of cooling the inner plate by a combination of three cooling means or film cooling means, impingement cooling means and pin fin cooling means. The combustor is simple in construction, easy to fabricate, low in cost and yet high in strength. The localized area of the inner plate can be cooled efficiently by film cooling.

What is claimed is:

1. A combustor of a gas turbine comprising:

wall means of double wall construction including an outer plate member and an inner plate member located at least in one part of the combustor;

connector means including a multiplicity of connector pins formed of heat conductive material for connecting together the outer plate member and inner plate member of the wall means; and cooling air flow aperture means including a multiplicity of cooling air inlet apertures formed in the outer plate member to introduce cooling air therethrough from outside into a spaced defined between the outer and inner plate members perpendicularly to an outer surface of the inner plate, and a multiplicity of cooling air outlet apertures formed in the inner plate member to allow the cooling air to flow along an inner surface of the inner plate after being released into the interior of the combustor from the space between the outer and inner plate members, said cooling air outlet apertures formed in said inner plate member being inclined and said cooling air inlet apertures formed in said outer plate member being greater in diameter but smaller in total area than said cooling air outlet apertures.

2. A combustor of a gas turbine as claimed in claim 1, wherein said cooling air outlet apertures are in the form of slits.

3. A combustor of a gas turbine as claimed in claim 2 wherein said inner plate member is composed of rectangular members resembling tiles, to define the cooling air outlet slits therebetween.

4. A combustor of a gas turbine as claimed in claim 1 wherein said inner plate member and outer plate member substantially equal in axial length.

5. A combustor of a gas turbine as claimed in claim 1 wherein the ratio of the total area of the cooling air outlet apertures to the total area of the cooling air inlet apertures is approximately 3 to 4.

6. A combustor of a gas turbine as claimed in claim 1 wherein said wall means extends over a major portion of the surface of said combustor.

7. A combustor of a gas turbine as claimed in claim 1 wherein said cooling air outlet apertures formed in said inner plate member are inclined at an angle of 30 degrees.

8. A combustor of a gas turbine as claimed in claim 1 wherein said cooling air outlet apertures are located offset from said cooling air inlet apertures.

* * * * *